US009217992B2

(12) United States Patent
Stranczl et al.

(10) Patent No.: US 9,217,992 B2
(45) Date of Patent: Dec. 22, 2015

(54) TIMEPIECE BALANCE SPRING ADJUSTMENT MECHANISM

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 11 days.

(21) Appl. No.: 14/204,098

(22) Filed: Mar. 11, 2014

(65) Prior Publication Data

US 2014/0286143 A1 Sep. 25, 2014

(30) Foreign Application Priority Data

Mar. 19, 2013 (EP) ..... 13160029

(51) Int. Cl.
*G04B 18/06* (2006.01)
*G04B 18/02* (2006.01)

(52) U.S. Cl.
CPC ..... *G04B 18/06* (2013.01); *G04B 18/025* (2013.01)

(58) Field of Classification Search
CPC ..... G04B 18/06
USPC ..... 368/178
See application file for complete search history.

(56) References Cited

U.S. PATENT DOCUMENTS

| | | | | |
|---|---|---|---|---|
| 3,896,614 | A | 7/1975 | Bachmann | |
| 7,059,764 | B2 * | 6/2006 | Hintze et al. | 368/127 |
| 7,237,945 | B2 * | 7/2007 | Geyer | 368/178 |
| 2005/0073912 | A1 * | 4/2005 | Geyer | 368/127 |
| 2007/0091729 | A1 * | 4/2007 | Takahashi | 368/170 |
| 2012/0082010 | A1 * | 4/2012 | Boulenguiez et al. | 368/184 |
| 2012/0176869 | A1 * | 7/2012 | Gonthier | 368/175 |
| 2012/0243386 | A1 * | 9/2012 | Semon | 368/129 |
| 2013/0064046 | A1 * | 3/2013 | Rochat | 368/177 |

FOREIGN PATENT DOCUMENTS

| | | |
|---|---|---|
| CH | 577 194 | 6/1976 |
| DE | 1 676 077 | 5/1954 |
| DE | 2 041 114 | 2/1972 |
| DE | 75 39 924 | 5/1976 |
| EP | 2 605 079 A1 | 6/2013 |
| EP | 2 605 087 A1 | 6/2013 |
| FR | 2 253 235 | 6/1975 |
| GB | 705991 | 3/1954 |

OTHER PUBLICATIONS

European Search Report issued Sep. 25, 2013, in Patent Application No. EP 13 16 0029, filed Mar. 19, 2013 (with English-language translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A mechanism for adjusting the active length of a timepiece balance spring whose outer end is fixed to a balance spring stud secured to a bar. This mechanism includes two pins for clamping or touching the outer coil of the balance spring during the operation of this balance spring. These two pins are in a single piece with this bar.

8 Claims, 4 Drawing Sheets

TIMEPIECE BALANCE SPRING ADJUSTMENT MECHANISM

This application claims priority from European Patent application No. 13160029.8 filed Mar. 19, 2013, the entire disclosure of which is hereby incorporated by reference.

FIELD OF THE INVENTION

The invention concerns a mechanism for adjusting the active length of a timepiece balance spring, the outer end of which is fixed to a balance spring stud secured to a bar, said mechanism including two pins for clamping or touching the outer coil of said balance spring during the operation of said balance spring.

The invention also concerns a mechanical timepiece movement including at least one mechanism of this type.

The invention concerns the field of timepiece mechanisms, and more specifically movements with a regulating member including a balance spring whose active length is adjustable or pre-adjustable. The invention more particularly concerns the field of movements incorporating functional modules which are ready to use.

BACKGROUND OF THE INVENTION

The use of modular assemblies permits the manufacture of families of products using a common base, each personalised by different options or functions, notably complications in the case of a mechanical timepiece movement.

The concept of extremely high precision modules or cassettes allows large scale production to be combined with high quality goods.

Thus, modular sub-assemblies for timepiece movements are known, from EP Patent Application Nos 11193173.9 and 11193174.7 in the name of ETA SA. The mechanical modules disclosed in these Patent Applications are irreversibly pre-adjusted and assembled to ensure the durability of their settings.

However, in a conventional embodiment, the modules do not always allow for a reduction in the number of components, which would both reduce production costs and simplify the assembly plan, enabling mid-level technical personnel to assemble and adjust the most complex functions.

Adjusting the active length of the balance spring is conventionally achieved using an index assembly having several components, which is expensive and cumbersome.

CH Patent Application No 577194B5 in the name of Ebauches Bettlach discloses a pinning and index assembly device, wherein the index has a profiled aperture delimiting several tongues, which are at least partially bent obliquely; the balance cock has a flat annular portion surrounding the balance bearing, and the tongues of the index extend partly above and below the cock.

GB Patent Application No 705 991A in the name of Francis Atkinson discloses an aperture having inward facing resilient tongues for clamping a balance staff pin.

SUMMARY OF THE INVENTION

Thus, the invention proposes to provide a mechanism for adjusting the active length of a balance spring, which has a reduced number of components and is easy to assembly and adjust.

The present invention utilises, for this purpose, the new micro-component manufacturing technologies, MEMS, "LIGA", lithography and suchlike, to optimise the manufacture of the modules, shown here as cassettes. These cassettes may be irreversibly assembled to each other as in the above two Patent Applications, or positioned and assembled in a conventional manner.

The invention therefore concerns a mechanism for adjusting the active length of a timepiece balance spring whose outer end is fixed to a balance spring stud secured to a bar, said mechanism including two pins for clamping or touching the outer coil of the balance spring during the operation of said balance spring, characterized in that said two pins are in a single piece with said bar.

According to a feature of the invention, at least one of said pins is secured to said bar by an elastic return means which is in a single piece with said at least one pin and said bar, and which tends to move said pin closer to the other pin.

According to a feature of the invention, said stud is in a single piece with said bar.

According to a feature of the invention, said stud is secured to said bar by an elastic return means in a single piece with said stud and said bar.

According to a feature of the invention, said balance spring is in a single piece with said stud.

According to a feature of the invention, said balance spring is in a single piece with said stud and with said bar.

The invention also concerns a mechanical timepiece movement including at least one mechanism of this type.

The fact of making monolithic components, and in particular with a bar, has the advantage of reducing the number of parts, and avoiding assembly problems. The invention benefits from the precision with which these monolithic components are made (typically, the parts are for example made of silicon and therefore enjoy micrometric precision).

The monolithic mechanism has the main advantage of guaranteeing the distances between centres and forming a ready-to-use mechanism, in particular an oscillator in a preferred application.

The invention incorporates, in particular, flexible guide members, which have the following advantages:

- guaranteed precision;
- very reduced or zero friction level;
- no hysteresis in the movements, due to the absence of friction or at least the extremely reduced level of friction;
- no lubrication;
- no play;
- no wear.

The manufacture of the flexible guide members results in limitations, notably a limited travel, low return forces, and a limited charge. However, these limitations are not prohibitive for a number of horological functions, in particular those which relate to regulation.

These limitations are amply compensated for by the high precision of the distance between centres, the small number of components to be made and hence the reduced complexity and assembly time.

A mechanism according to the invention has a great industrial advantage: the mechanism cassette, particularly an oscillator, forms a component ready for assembly in a movement. Further, there is nothing to prevent an entire movement being devised in the form of a mechanism of the invention.

BRIEF DESCRIPTION OF THE DRAWINGS

Other features and advantages of the invention will appear upon reading the following detailed description, with reference to the annexed drawings, in which:

FIG. 8 illustrates the adjustment of a pivot for hooking a balance spring via an elastic adjustment means including a comb, the clamping in position of the comb in an adjusted position, and a locking mechanism controlling this clamping means.

FIG. 9 illustrates a similar example where the comb is held between two flexible strips and forms a bistable component.

FIG. 10 illustrates a similar mechanism with a comb immobilising an index located at the end of a flexible strip, the comb being pressed onto the index by a clamping strip-spring which is in turn immobilised by a locking finger.

DETAILED DESCRIPTION OF PREFERRED EMBODIMENTS

Figure 1:
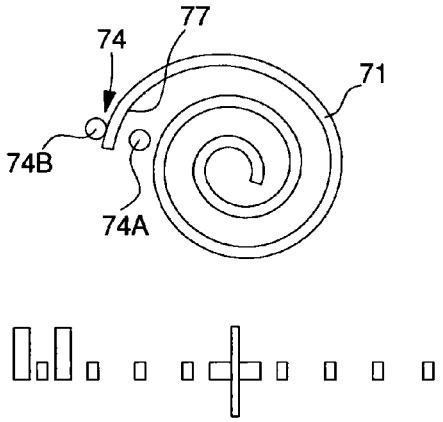
FIG. 1 shows a plan view and side view of a balance spring whose outer end is clamped or touched by pins in a single piece with a bar, said pins having some play with the balance spring, which is in contact with one or other of the pins when it is being wound or let down.

The invention concerns the field of timepiece mechanisms, and more specifically regulating members. The invention particularly concerns the adjustment of the active length of a balance spring, preferably in the context of movements incorporating ready-to-use functional modules.

The adjustment of the active length of the outer coil of balance spring 71 may be achieved in various manners.

The invention concerns a mechanism 1 for adjusting the active length of a timepiece balance spring 71, the outer end of which is fixed to a balance spring stud 73 secured to a bar 3. This mechanism 1 includes two pins 74 for clamping or touching the outer coil 77 of balance spring 71, during the operation of the balance spring, at a distance from stud 73, in order to determine the active length of the balance spring limited to the clamping or contact point.

Figure 2:
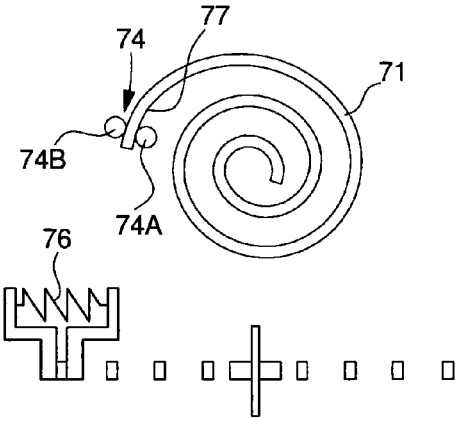
FIG. 2 shows a plan view and a side view of a pair of pins of this type clamping the balance spring as a result of integrated elastic return means.

In an embodiment without any play, as seen in FIG. 2, at least one of these pins 74A and 74B is connected to bar 3 by an elastic return means 76, which is also integrated in bar 3, this pair of pins 74A and 74B clamps the balance spring as a result of integrated elastic return means 76. FIG. 1, however, illustrates an embodiment with very slight play, wherein the radial, independent adjustment of pins 74A and 74B permits the adjustment of the isochronism of the movement in the various positions, and balance spring 71 is in contact with at least one pin or the other when it is wound or let down.

According to the invention, these two pins 74 are in a single piece with bar 3.

In particular, at least a first of said pins 74 is fixed to bar 3 by elastic return means 76 which is in a single piece with said at least one pin 74 and bar 3. This elastic return means 76 tends to moves said first pin 74 closer to the other pin 74. This elastic return means 76 is formed, in particular, of one or more flexible elements, located either in the plane of balance spring 71, or in the plane of bar 3, or in any other plane. In an advantageous variant, balance spring 71 and/or pins 74A or 74B may be notched locally to allow for discrete, notch-by-notch adjustment.

In an advantageous variant, this stud 73 is fixed to bar 3 by elastic return means 75 which is in a single piece with stud 73 and bar 3.

Figure 5:
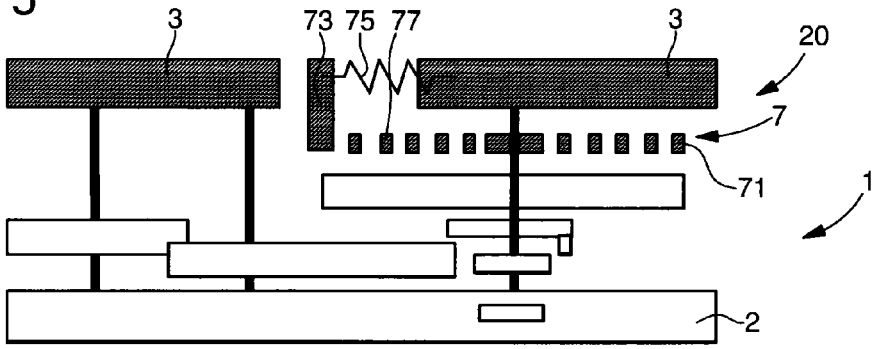
FIG. 5 shows, like FIG. 3, a variant wherein the balance spring is made in a single piece with a stud, which is in turn in a single piece with the bar to which it is connected by integrated elastic return means, with the pins not shown.
Figure 8:
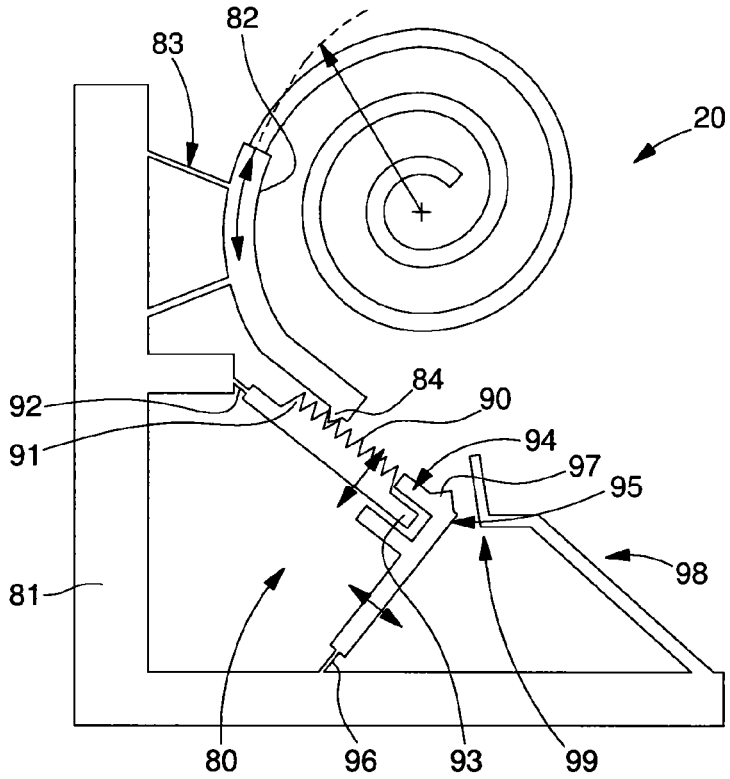
FIGS. 8, 9 and 10 show a plan view of a monolithic assembly comprising a means of adjusting the position of a component which is also integrated in the assembly, said adjustment means being lockable in position by a clamping means; the component to be adjusted may be the stud holding the balance spring externally, or one of the pins for adjusting the active length of the balance spring, or both pins.
Figure 9:
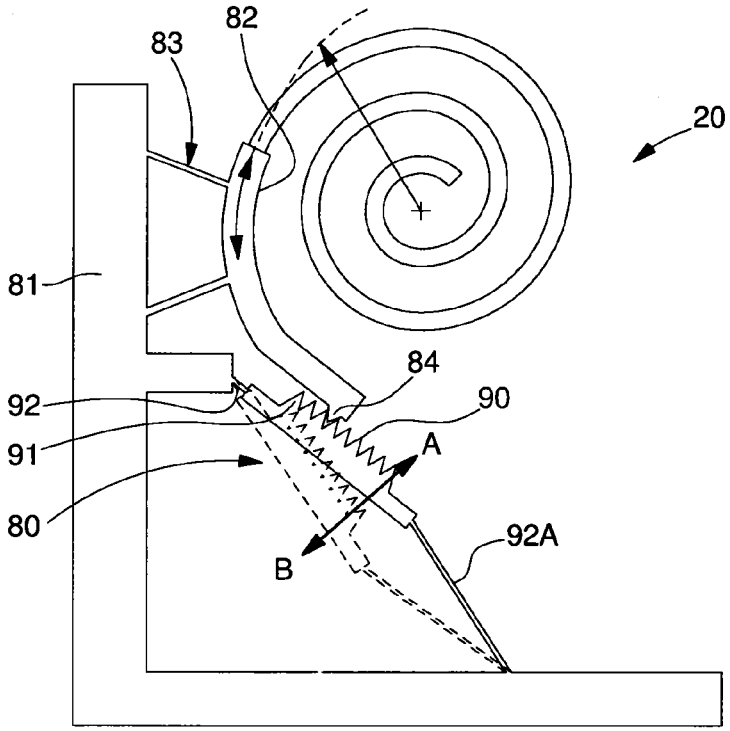
Figure 10:
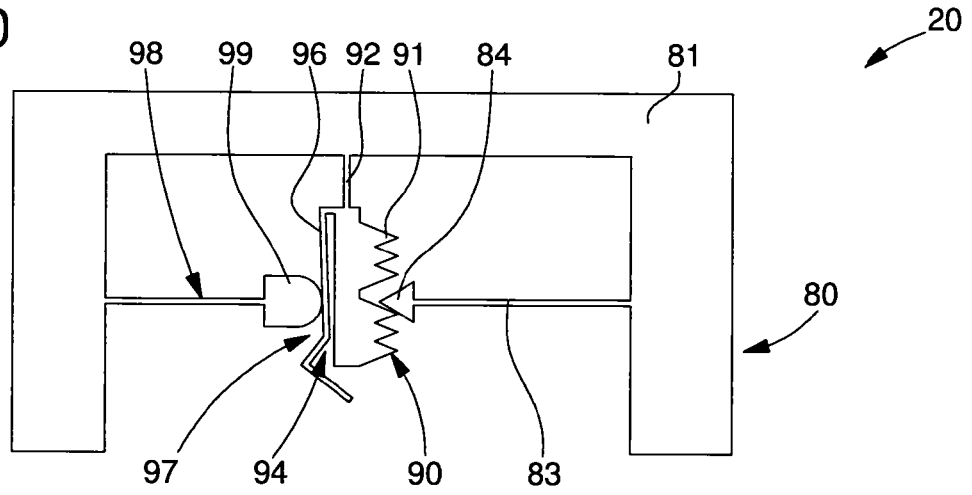

In a particular embodiment, stud 73 is in a single piece with bar 3. In the FIG. 5 variant, balance spring 71 is made in a single piece with a stud 73 to which the balance spring is attached via its outer coil 77. This stud 73 is in turn made in a single piece with bar 3, to which it is connected by an integrated elastic return means 75 made in a single piece with stud 73 and bar 3. Preferably, the adjustment of the stud position, achieved by exploiting the elasticity of the elastic return means, is maintained by clamping means, not shown in FIG. 5, but an example of which is shown in FIGS. 8 to 10.

This mode of securing the stud is applicable in the same manner to one of pins 74, or to both pins 74A and 74B, independently of each other, or to the pair of pins 74A and 74B held together. An advantageous position adjustment variant applicable to each of these components or group of components will be seen below. To simplify the description, each mechanism is described only in relation to the stud; those skilled in the art will be able to apply the invention to a pin, pair of pins, balance bearing, or other element.

Figure 6:
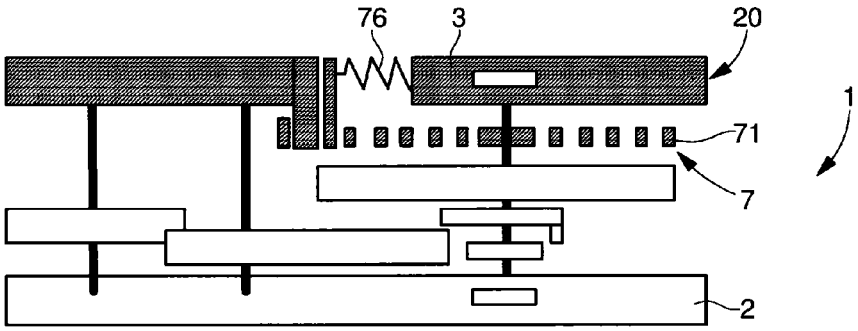
FIG. 6 shows, in a similar manner to FIG. 3, a variant wherein the balance spring is made in a single piece with a stud, which is in turn in a single piece with the bar, and wherein the outer end of the balance spring is clamped by pins formed in a single piece with the bar, and at least one of which is connected by integrated elastic return means to the bar.
Figure 7:
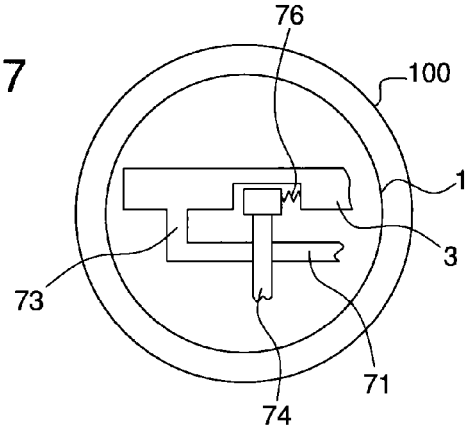
FIG. 7 is a diagram of a timepiece movement incorporating a mechanism for adjusting the active length of the balance spring of the invention.
Figure 3:
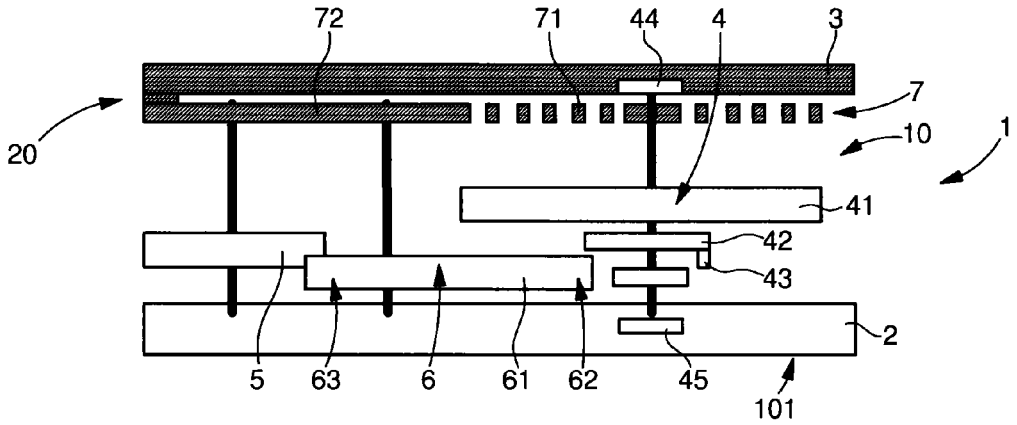
FIG. 3 shows a schematic, side view of an escape mechanism according to the invention, including the balance spring made in a single piece with a bar, in two superposed joined layers.
Figure 4:
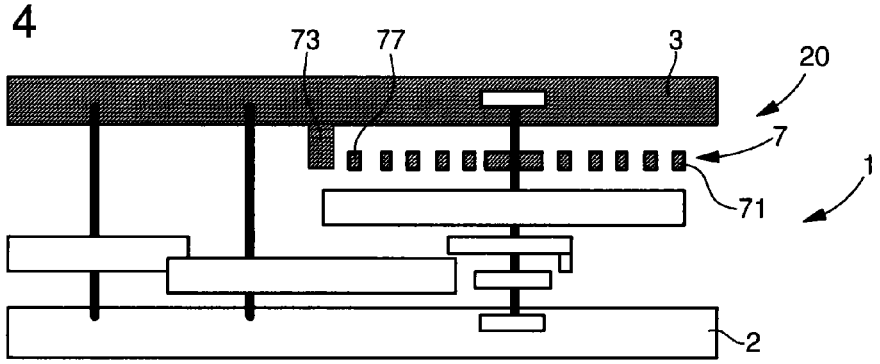
FIG. 4 shows, like FIG. 3, a similar variant, wherein it is only the balance spring stud which forms the link between the top level of the bar and the bottom level of the balance spring, with the pins not shown.

In a preferred embodiment, balance spring 71 is in a single piece with stud 73. FIG. 6 therefore shows a variant where balance spring 71 is also made in a single piece with a stud 73, which is in turn made in a single piece with bar 3, and where the outer end of the balance spring is clamped, at a distance from stud 73, by pins 74A and 74B in a single piece with bar 3, together forming the equivalent of an index 74 for modifying the active length of balance spring 71.

In another variant, balance spring 71 is held in a flexible index 74 of this type with pins 74A and 74B. Index 74 is in a single piece with bar 3, although balance spring 71 is not necessarily in a single piece with stud 73 or with bar 3.

In a completely integrated embodiment, balance spring 71 is in a single piece with stud 73 and with bar 3 which, in turn, according to the invention, is in a single piece with pins 74.

FIGS. 8, 9 and 10 show a plan view of a monolithic assembly including a means of adjusting the position of a component which is also integrated in the assembly, said adjustment means being locked in position by a clamping means; the component to be adjusted may be stud 73 for holding balance spring 71 externally, or one of the pins 74A, 74B for adjusting the active length of the balance spring, or both of pins 74A and 74B.

Thus, in a particular embodiment, at least bar 3 includes a position adjustable mechanism 80 comprising a rigid carrier structure 81 (formed, in particular, by the actual bar plate), using at least one elastic strip 83, of a position adjustable component 82. This adjustable component 82 carries at least one of said pins 74, or stud 73 or a pivot point. Mechanism 80 includes an indexing means 84 arranged to cooperate with a complementary indexing means 91 comprised in an adjustment mechanism 90. This complementary indexing means 91 is detachably mounted to indexing means 84 and can be locked in a cooperating position by a clamping mechanism 94 elastically fixed to structure 81.

The clamping mechanism 94 is in turn subjected to the action of a locking mechanism 98 which allows mechanism 94 to occupy either an uncoupled position in which adjustment mechanism 90 is free, or a coupled position in which clamping mechanism 94 hinders adjustment mechanism 90. This locking mechanism is in turn also elastically fixed to structure 81. For easy pre-adjustment of mechanism 1, at least one of the functional components, such as stud 73 or pin 74, is position adjustable and is locked in a pre-adjusted position by a locking means.

For a particularly advantageous application to a mechanism which is adjustable and lockable, notably in a reversible manner, but which can also be locked (notably irreversibly) after an initial adjustment, mechanism 1 includes a position adjustable mechanism 80 of this type. FIGS. 8 and 9 illustrate a non-limiting application to the angular positioning of a stud 73 for holding a balance spring.

This position adjustable mechanism 80 includes a rigid structure 81 which carries, via at least one elastic strip 83, a position adjustable component 82. This rigid structure 81 may be plate 2, bar 3 or any of the non-detachable monobloc components 20 comprised in mechanism 1.

In the case of FIG. 8, this position adjustable component 82 includes an indexing means 84, which is arranged to cooperate with a complementary indexing means 91, here formed by a comb, or a toothed sector, comprised in adjustment mechanism 90. This complementary indexing means 91 is detachably mounted to indexing means 84. It can also be locked in a cooperating position by a clamping mechanism 94.

This clamping mechanism 94 is elastically fixed to structure 81 by at least one flexible element 96 and is preferably in turn subjected to the action of a locking mechanism which allows mechanism 94 to occupy either an uncoupled position in which adjustment mechanism 90 is free, or a coupled position in which clamping mechanism 94 hinders adjustment mechanism 90. This locking mechanism includes at least one flexible element 98 forming a jumper and elastically fixed to structure 81, said at least one flexible element 98 here includes a beak 99 which cooperates with a beak 97 of clamp 94 to hold the clamp away during the position adjustment, or with a complementary stop surface 95 of clamp 94 as security for the clamp when the position adjustment is carried out. The latter is in the form of a fork so as to limit the travel of an arm 93 comprised in comb 91.

FIG. 9 illustrates a similar example where comb 91 is held between two substantially aligned flexible strips 92 and 92A and form a bistable component, operating by buckling, the assembly can occupy two stable positions: a first activated position A where comb 91 cooperates with a finger 84 of a moveable stud 82 and a second release position B where the comb is disengaged from the finger.

FIG. 10 illustrates a similar mechanism with a comb 91 locking an index 84 located at the end of a flexible strip 83, comb 91 being pressed onto index 84 by a clamping strip-spring 96 belonging to clamp 94, which is in turn locked by a locking finger 99 mounted on at least one flexible strip 98, said finger 99 cooperating with a stop surface 97 of strip 96.

As seen above, this combined adjustment, clamping and locking mechanism, illustrated here for a particular application of adjusting a stud on a travel concentric to the arbour of a balance spring, is applicable to a wide range of applications: positioning a bearing, a stop member, or other element.

In a preferred embodiment, mechanism 1 according to the invention is made of silicon, and said integrated elastic return means comprised therein is pre-stressed in a silicon oxide state.

In an advantageous embodiment of mechanism 1 according to the invention, the non-detachable monobloc component is made of micromachinable material, or silicon, or silicon oxide, and the integrated elastic returns means of the non-detachable monobloc component is pre-stressed in a silicon oxide state. Other materials in MEMS or "LIGA" technology may be employed. Quartz, DLC, at least partially amorphous materials or metallic glasses, may be used for these applications, although the list is not limiting.

Particular structuring of bar 3 and/or the non-detachable monobloc components may compensate for the effects of expansion of these structural elements or components of mechanism 1. It is, for example, possible to make the plate in silicon, and then oxidise it, for the sake of consistency.

In a particular embodiment, the non-detachable monobloc component of mechanism 1 includes severable elements, intended to facilitate the assembly of the component in a larger unit, these severable elements then only need to be broken off to give one or more degrees of freedom to some of the constituents of the component.

In a particular embodiment, the integrated return means includes at least one flexible bistable or multi-stable element, as seen for example in FIG. 9, which shows a bistable element operating, and including a comb 91 between at least two elastic strips 92 and 92A, the assembly being capable of occupying two stable positions; a first activated position A where comb 91 cooperates with a finger 84 of a moveable stud 82 and a second release position B where it is detached therefrom.

In a particular embodiment such as that of FIG. 9, the first elastic flexible strip 92 and the second elastic flexible strip 92A are substantially aligned, and together form a bistable element which operates by buckling.

In another embodiment which is not illustrated in the Figures, the complementary indexing means 91 is attached to a rigid structure 81 in a suspended manner between more than two elastic flexible strips, the assembly forming a bistable or multi-stable element able to occupy at least two stable positions, a first activated position A where complementary indexing means 91 cooperates with indexing means 84 and a second release position B where it is detached therefrom. In a particular variant, these strips, of which there are more than two, are not collinear.

Advantageously, in these different variants, bar 3 incorporates pins limiting the travel of balance spring 71 (different from pins 74 which adjust the active length of the spring), which are in a single piece with said bar 3.

Generally speaking, this incorporation of limiting elements, regardless of whether they are in bar 3 or another non-detachable monobloc component, is an advantage of the invention.

The invention also concerns a mechanical timepiece movement 100 including at least one mechanism 1 of this type.

What is claimed is:

1. A mechanism for adjusting an active length of a timepiece balance spring whose outer end is fixed to a balance spring stud secured to a bar, said mechanism including two pins for clamping or touching an outer coil of the balance spring during operation of said balance spring, wherein said two pins are in a single piece with said bar, and wherein at least said bar includes a position adjustable mechanism including a rigid carrier structure, using at least one elastic strip, of a position adjustable component carrying at least one of said pins and including an indexing means arranged to cooperate with a complementary indexing means comprised in an adjustment mechanism, said complementary indexing means being detachably mounted to the indexing means and being lockable in a cooperating position by a clamping mechanism elastically fixed to said structure, said clamping mechanism being in turn subjected to the action of a locking mechanism which allows said clamping mechanism to occupy either an uncoupled position wherein said adjustment mechanism is free, or a coupled position wherein said clamping mechanism hinders said adjustment mechanism, said locking mechanism being also elastically fixed to said structure.

2. The mechanism according to claim 1, wherein at least one of said pins is secured to said bar by an elastic return means which is in a single piece with said at least one pin and said bar, and which tends to move said pin closer to the other pin.

3. The mechanism according to claim 2, wherein the mechanism is made of silicon, and said integrated elastic return means comprised therein is pre-stressed in a silicon oxide state.

4. The mechanism according to claim 1, wherein said stud is in a single piece with said bar.

5. The mechanism according to claim 4, wherein said stud is fixed to said bar by an elastic return means which is in a single piece with said stud and said bar.

6. The mechanism according to claim 1, wherein said balance spring is in a single piece with said balance spring stud.

7. The mechanism according to claim 6, wherein said balance spring is in a single piece with said balance spring stud and said bar.

8. The mechanical timepiece movement including at least one mechanism according to claim 1.

* * * * *